US005425430A

United States Patent [19]

Roberts

[11] Patent Number: 5,425,430

[45] Date of Patent: Jun. 20, 1995

[54] JAR ENHANCER

[75] Inventor: Billy J. Roberts, Houston, Tex.

[73] Assignee: Houston Engineers, Inc., Houston, Tex.

[21] Appl. No.: 187,707

[22] Filed: Jan. 27, 1994

[51] Int. Cl.[6] ..... E21B 31/107

[52] U.S. Cl. ..... 175/296; 175/299; 175/300; 166/178

[58] Field of Search ..... 166/178; 175/296, 299, 175/321

[56] References Cited

U.S. PATENT DOCUMENTS

| | | | |
|---|---|---|---|
| 3,834,472 | 9/1974 | Perkins . | |
| 4,545,444 | 10/1985 | Webb et al. . | |
| 4,844,157 | 7/1989 | Taylor | 166/178 |
| 4,846,273 | 7/1989 | Anderson et al. . | |
| 4,865,125 | 9/1989 | DeCuir | 166/178 |
| 5,022,473 | 6/1991 | Taylor | 166/178 X |
| 5,139,086 | 8/1992 | Griffith, Sr. | 175/299 X |
| 5,174,393 | 12/1992 | Roberts et al. | 166/178 X |
| 5,232,060 | 8/1993 | Evans | 166/178 X |

FOREIGN PATENT DOCUMENTS 2210082 6/1989 United Kingdom .

*Primary Examiner*—Ramon S. Britts
*Assistant Examiner*—Frank S. Tsay
*Attorney, Agent, or Firm*—Vaden, Eickenroht, Thompson & Feather

[57] ABSTRACT

There is disclosed a tool for enhancing the impact delivered to an object stuck in a well bore by means of a jar having a first tubular member connected to the object and a second tubular member having a hammer arranged to deliver an upward blow to an anvil on the first member in response to raising and a downward blow in response to lowering of the second tubular mandrel member with respect to the first member, the tool comprising a first tubular member having a lower end adapted to be connected to the second tubular member of the jar for raising and lowering therewith, a second tubular member vertically reciprocable with respect to the first member to form on annular space between them and having an upper end adapted to be connected to a well pipe string above it, and first and second sets of upper and lower longitudinally spaced seal rings within the annular space and sealably slidable with respect to equal diameter portions of each of the tubular members to form upper and lower fluid chambers between the upper and lower seal rings, and shoulders on the tubular members in the annular space so arranged that, upon filling of the chambers with a compressible fluid, raising of the second member will compress the fluid in the upper and lower chambers to enhance the impact of an upward jar and lowering of the second member will compress the fluid in the lower chamber to enhance the impact of a downward jar.

8 Claims, 3 Drawing Sheets

JAR ENHANCER

This invention relates generally to a tool for enhancing the impact of a jar delivered to an object stuck in a well bore. In one of its aspects, it relates to improvements in a tool of this type for enhancing the impacts of both upward and downward blows delivered to the object.

BACKGROUND OF THE INVENTION

As well-known in the art, a double-acting jar of the type described comprises a first tubular member or outer housing adapted to be connected to the object and a second tubular member or inner mandrel adapted to be connected as part of a pipe string and arranged telescopically of the first member or housing and having a hammer arranged to deliver an upward blow to an anvil on the housing in response to raising and a downward blow in response to lowering of the mandrel with respect to the housing. In an hydraulic jar, the mandrel carries a detent mechanism arranged to slide within a restricted bore of a chamber in the housing in which hydraulic fluid is contained. Thus, the detent mechanism is of such construction as to permit only limited flow past it, during its travel through the restricted bore, so as to build up tension in the mandrel as it is raised therethrough or compression therein as it is lowered therethrough. Consequently, as the detent moves out of the restricted bore, the mandrel and thus the hammer thereon is released to deliver either an upward or downward blow to the anvil of the housing and thus the stuck object to which the housing is connected.

As also well-known in the art, the object stuck in the well bore may be a "fish" onto which the lower end of the housing of the jar is lowered for connection thereto. Or, the object may be a lower part of the pipe string itself and thus already connected to the housing of the jar.

It is well-known in the art to enhance the impact of such jars by means of a so-called jar enhancer comprising a second tubular member or inner mandrel having an upper end adapted to be connected to the well pipe string above it, and a first tubular member or outer housing arranged telescopically of the mandrel member to form an annular space between them and having a lower end adapted to be connected to the mandrel member of the jar (or to drill collars above the jar) for raising and lowering therewith. More particularly, the space may be a pressure chamber which is filled with a compressible fluid which may be a gas, such as nitrogen, or a compressible liquid, such as silicone, and a piston on the mandrel may sealably slide with respect to the bore of the housing to compress the fluid in the space above it as the mandrel is raised, in the case of an upward jar, or below it as the second member is lowered, in the case of a downward jar.

In a jar, the second tubular member or mandrel on which the hammer is carried has a certain amount of "free" travel following movement of the detent out of the restricted bore and as the hammer moves to strike the anvil. In jar enhancers prior to the invention disclosed in U.S. Pat. No. 4,846,273, the second tubular member or mandrel on which the piston is carried conventionally had a certain amount of "free" travel before it is moved into the restricted bore to accumulate energy.

In accordance with U.S. Pat. No. 4,846,273, however, it was proposed to provide a jar enhancer having an initial "free" travel at least as great as that of the jar, thereby insuring that accumulated energy was applied to the stuck object. Although representing a substantial advance over the prior art in this respect, the jar enhancer of the aforementioned patent is of relatively complex construction and expensive to manufacture, including a large number of parts which cause it to be quite long and difficult to service and repair. Also, at least in the version of the jar enhancer of FIGS. 6 and 7 of U.S. Pat. No. 4,846,273, the piston moving in the restricted bore is of necessarily complex construction to enable it to move in the opposite direction through the restriction following the jarring event.

Pending patent application Ser. No. 08/145,481, filed Oct. 19, 1993, and assigned to the assignee of the present application, discloses a double-acting jar enhancer of this general type which overcomes these and other problems with those of the prior art in that it is of simpler and less expensive construction. Thus, in accordance with the embodiment of the improved jar enhancer illustrated in the prior application, upper and lower longitudinally spaced seal rings are disposed within the annular space between the tubular members for sealably sliding with respect to equal diameter portions of each, the first member or housing adapted to be connected to the second tubular member or mandrel of the jar has an upper shoulder engagable with the upper ring to limit its movement in a downward direction and a lower shoulder engagable with the lower ring to limit its movement in an upward direction, and the second member or mandrel adapted to be connected to the well string above it has an upper shoulder engagable with the upper ring to raise the upper ring with it, upon raising of the second tubular member, and a lower shoulder engagable with the lower ring to lower the lower ring with it, upon lowering of the second tubular member. More particularly, means are provided to form upper and lower sliding seals between the first and second tubular members along the diameter portion of the first member to form an upper pressure chamber within the space above the upper seal ring and a lower pressure chamber within the space below the lower seal ring, whereby, with the upper and lower chambers filled with a compressible fluid, raising of the second member will compress the fluid in the upper chamber to enhance an upward jar and lowering of the second member will compress the fluid in the lower chamber to enhance the impact of a downward jar. Preferably, the shoulders on the first member are essentially adjacent the upper and lower seal rings when said second tubular member is in a neutral position.

Although the jar enhancer of the prior application represents a substantial advance over prior jar enhancers of this general type, there is a need in the industry, particularly as wells are drilled to greater depths, to be able to apply greater loads to the jar enhancer without exceeding its burst strength. Of course, one obvious solution would be to use multiple, end-to-end jar enhancers, but this would multiply the costs proportionately. On the other hand, due to the rigid constraints of space within the well bore, it is not practical to merely increase its diameter and thus the effective pressure-responsive areas in its fluid chambers. Consequently, it is the object of this invention to provide an improved jar enhancer of this type which is of such construction as to reduce the pressure in each fluid chamber by fifty percent or more for any given load without increasing its outer diameter or substantially increasing its cost.

SUMMARY OF THE INVENTION

These and other objects are accomplished, in accordance with the novel aspects of this invention, by a jar enhancer of the type described comprising, as in the jar enhancer of the prior application, a first tubular member having a lower end adapted to be connected to said second tubular member of the jar for raising and lowering therewith, and a second tubular member vertically reciprocable with respect to the first member to form on annular space between them and having an upper end adapted to be connected to a well pipe string above it, together with upper means on the first tubular member sealably slidable with respect to the second tubular member and means on the second tubular member sealably slidable with respect to the first tubular member to form an upper pressure chamber in the space between them, and lower means on the first tubular member sealably slidable with respect to the second tubular member and on second tubular sealably slidable with respect to the first tubular member, to form a lower pressure chamber in the space between them. Thus, with the chambers filled with a compressible fluid, movement of the second member in one vertical direction with respect to the first member will compress the fluid in the upper and lower chambers to enhance the impact of a jar in the same vertical direction.

In one embodiment of the invention, the upper and lower chambers may be above the means on the first member so that raising of the second tubular member will enhance the impact of an upward jar. In another embodiment, the upper and lower chambers may be below the means on the first tubular member so that raising of the second tubular member will enhance the impact of a downward jar. As disclosed, the second member is reciprocable within the first member. Thus, for a given load, the pressure in each chamber is half that in the chamber of the jar enhancer of the prior application in which fluid is compressed in response to a similar load, or even less than half if multiple uper and lower chambers are provided.

In the illustrated and preferred double-acting jar enhancer, a first set of upper and lower longitudinally spaced seal rings within the annular space are sealably slidable with respect to equal diameter portions of each of the tubular members, and a second set of upper and lower longitudinally spaced seal rings within the annular space and sealably slidable with respect to equal diameter portions of each of the tubular members, with the first member having a first set of upper and lower longitudinally spaced shoulders engagable respectively with the upper and lower rings of the first set to limit their movement in a downward direction and a second set of upper and lower longitudinally spaced shoulders engagable respectively with the upper and lower rings of the second set to limit their movement in an upward direction, and the second member having a first set of upper and lower shoulders engagable with the upper and lower rings of the first set to raise the upper and lower rings of the first set with it, upon raising of the second member, and a second set of upper and lower longitudinally spaced shoulders engagable with the upper and lower rings of the second set to lower the upper and lower rings of the second set with it, upon lowering of the second member. Thus, the upper seal rings of the first and second sets form the upper pressure chamber between them, and the lower seal rings of the first and second sets form the lower pressure chamber between them, whereby, with the chambers filled with a compressible fluid, raising of the second member will compress the fluid in the chambers to enhance the impact of an upward jar and lowering of the second member will compress the fluid in the chambers to enhance the impact of a downward jar.

A means is formed in the outer of the first and second member through which fluid may be introduced into a charging or fill chamber between the members intermediate the upper seal ring of the first set and lower seal ring of the second set, the upper of the first set of seal rings has valve means to permit flow from the charging chamber only into the upper chamber, and the lower of the second set of seal rings has valve means to permit flow from the charging chamber only into the lower pressure chamber.

In the drawings, wherein like reference characters are used throughout to designate like parts:

DESCRIPTION OF THE PREFERRED EMBODIMENT

Figure 1A:
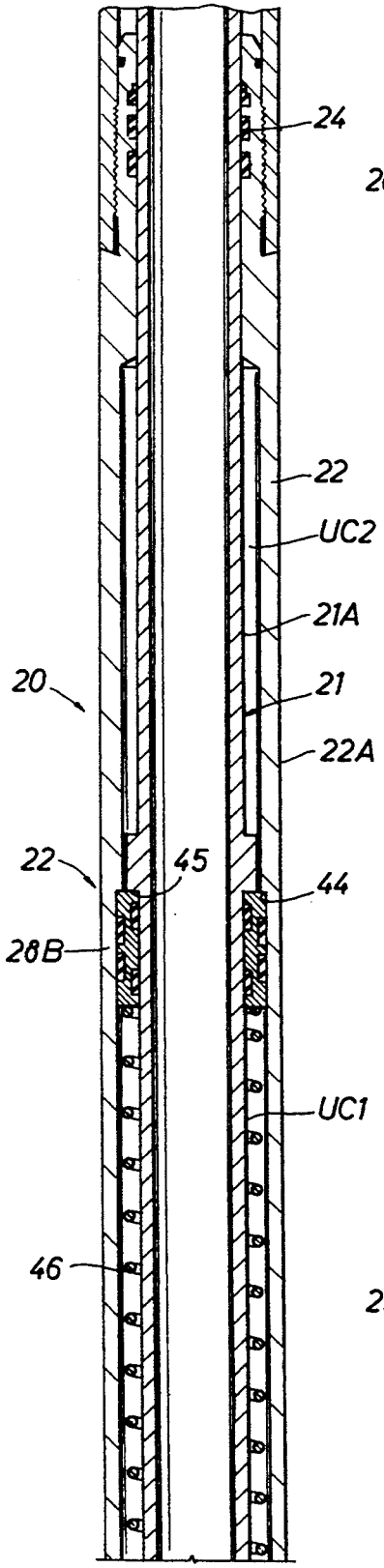
FIGS. 1A, 1B and 1C are longitudinal sectional views of the upper, intermediate and lower portions of a double-acting jar enhancer constructed in accordance with the present invention, and with the tubular members disposed in a neutral position prior to the initiation of either an upward or downward jar.

With reference now to the details of the drawings, the over-all jar enhancer, which is indicated in its entirety by reference character 20, is shown to comprise a second tubular member or mandrel 21 having an upper end adapted to be connected to the lower end of a well pipe string (not shown) above it, and a first tubular member or housing 22 surrounding the mandrel and vertically reciprocable with respect to it to form an annular space between the members and having a lower end adapted to be connected to the mandrel (not shown) of a jar on which the hammer is mounted. The jar itself may, of course, be constructed in a well-known manner, and thus need not be described herein, it being sufficient for the purposes of the present application to describe the hammer of the jar as being raised and lowered with the first tubular member or housing of the jar enhancer.

Although vertically reciprocable with respect to one another, the tubular members 21 and 22 of the jar enhancer are held against rotation with respect to one another, as by means of a drive mechanism of some type above it. Thus, the outer tubular member is caused to rotate with the inner tubular member and thus the pipe string above it, such that similar rotation may be imparted to parts of the jar below the jar enhancer.

The upper portion of the tubular member or mandrel 21 is slidable within packing 24 carried about the upper end of housing 22, while the lower portion of the tubular member of the mandrel is slidable within packing 25 carried about a lower portion of the housing. These portions of the mandrel and housing, and thus the packings 24 and 25, have equal sealing diameters and serve to exclude debris from the annular space between the members.

The outer tubular member or housing 22 is made up of upper tubular section 22A on which packing 24 is carried, a lower tubular section 22B on which the packing 25 is carried, and a central connector 22C threadedly connecting the upper and lower tubular sections 22A and 22B to one another. A lowermost section 22D of the housing 22 at the lower end of section 22B is connected to the inner mandrel of the jar beneath it.

The inner tubular member or mandrel 21 is in turn comprised of an upper tubular section 21A which is slidably received within packing 24 and whose upper end is adapted to be connected to the upper portion of the pipe string above it, and a lower tubular section 21B slidably received within the packing 25, as well as an intermediate connector portion 21C. The connector section has an enlarged outer diameter 26 which fits relatively closely within the inner diameter 27 of the connector section 22C of the tubular member 22.

A first set of upper and lower pistons or seal rings 28A and 29A are disposed within the annular space between the tubular members respectively above and below the enlarged diameter portion 26 of the mandrel, and a second set of upper and lower pistons or seal rings 28B and 29B are also disposed within the annular space above and below enlarged portion 26, but with the seal ring 28B of the second set being above the seal ring 28A of the first set, and the seal ring 29B of the second set being above the seal ring 29A of the first set. Thus, the upper seal rings form an upper chamber UC1 between them, while the seal rings 29B and 29A form a lower chamber LC1 between them. In addition, a second upper chamber UC2 is formed between the seal ring 28B and the upper packing 24, while a second lower chamber LC2 is formed between the lower seal ring 29A and the lower packing 25.

A one-way check-valve-controlled fill port 30 is formed in the connector section 22C of the housing to connect a fill chamber FC intermediate seal rings 28A and 29B. One-way check valve control passageways 32 and 31 are formed in the upper piston 28A and lower piston 29B, respectively, whereby, as will be described to follow, the upper and lower pressure chambers UC1 and LC1 may be filled with a compressible fluid from a suitable source connected to the outer end of the fill port 30. Thus, with the chambers filled, upward movement of the pistons 28A and 29A with respect to the housing will compress fluid in the chambers UC1 and LC1 above them, while downward movement of the pistons 28B and 29B with respect to the housing will compress fluid in the chambers UC1 and LC1 beneath them.

Figure 1B:
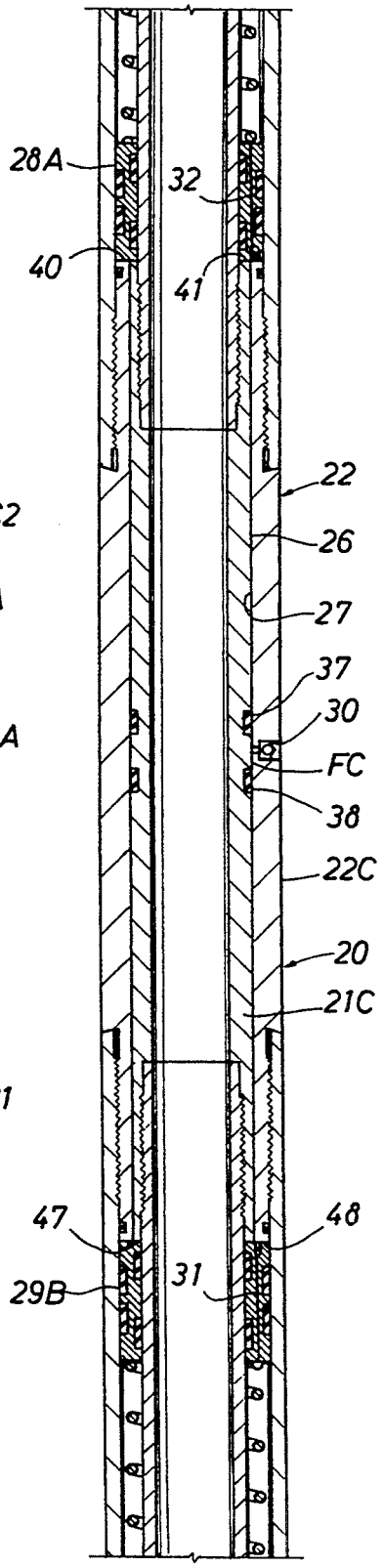
Figure 1C:
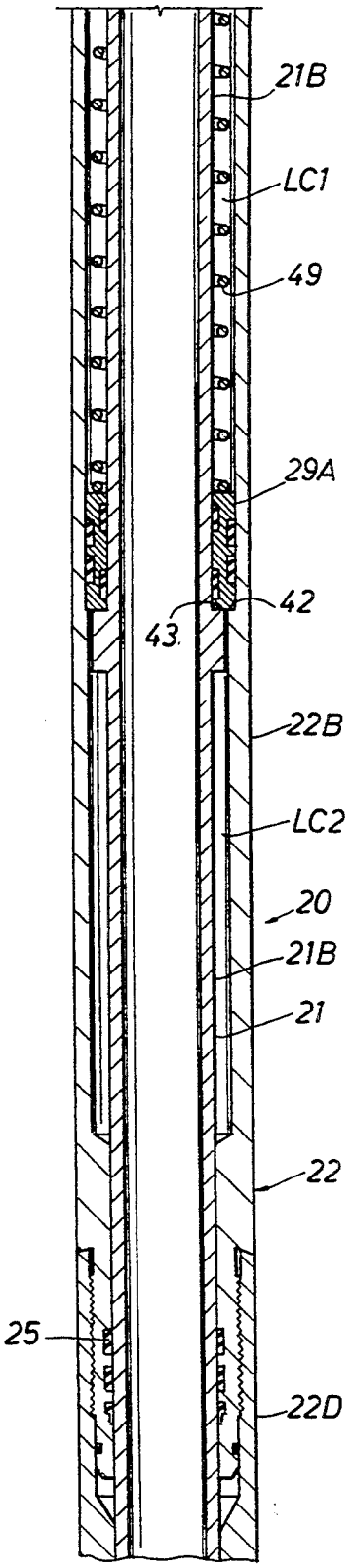

In the neutral position of the jar enhancer shown in FIGS. 1A, 1B, and 1C, upper piston 28A is supported by a shoulder 40 on the upper end of connector 22C and an adjacent shoulder 41 on the upper end of the enlarged diameter portion 26 of the mandrel section 21C. In this neutral position, the seal ring 28A is held in this position against these shoulders by pressure within the chamber UC1. The lower piston 29A of the first set is supported on an upwardly facing shoulder 42 on the lower section 22B of the housing and an adjacent shoulder 43 on the lower section 21B of the mandrel, the seal ring 29A being urged downwardly against the shoulders by the compressed fluid in the lower chamber LC1.

On the other hand, the upper piston or seal ring 28B is engaged at its upper end with a downwardly facing shoulder 44 on the upper section 22A of the housing and an adjacent shoulder 45 on the upper section 21A of the mandrel. This seal ring is urged against the shoulders, in the neutral position of the jar enhancer, by compressed fluid in the upper chamber UC1. For reasons to be described to follow, and as shown, a coil spring 46 is disposed within the annular space intermediate the rings 28B and 29A to urge them apart and thus toward the above described shoulders.

The upper end of the seal ring 29B is engaged with a downwardly facing shoulder 47 of the enlarged portion 26 of the mandrel, and an adjacent shoulder 48 formed on the lower end of the connector section 21C of the mandrel. The seal ring 29B is urged upwardly into engagement with the shoulders by the compressed fluid in the lower chamber LC1. In addition, another coil spring 49 is disposed within the annular space to urge the seal rings 29B and 29A apart and thus toward engagement with their respective shoulders on the mandrel and housing.

As shown, with the shoulders on the mandrel and housing adjacent to one another, in the neutral position of the jar enhancer, there is no "free" movement of the mandrel with respect to the housing—i.e., any movement either upward or downward of the mandrel will compress fluid in the chambers above and below the seal rings.

Figure 2A:
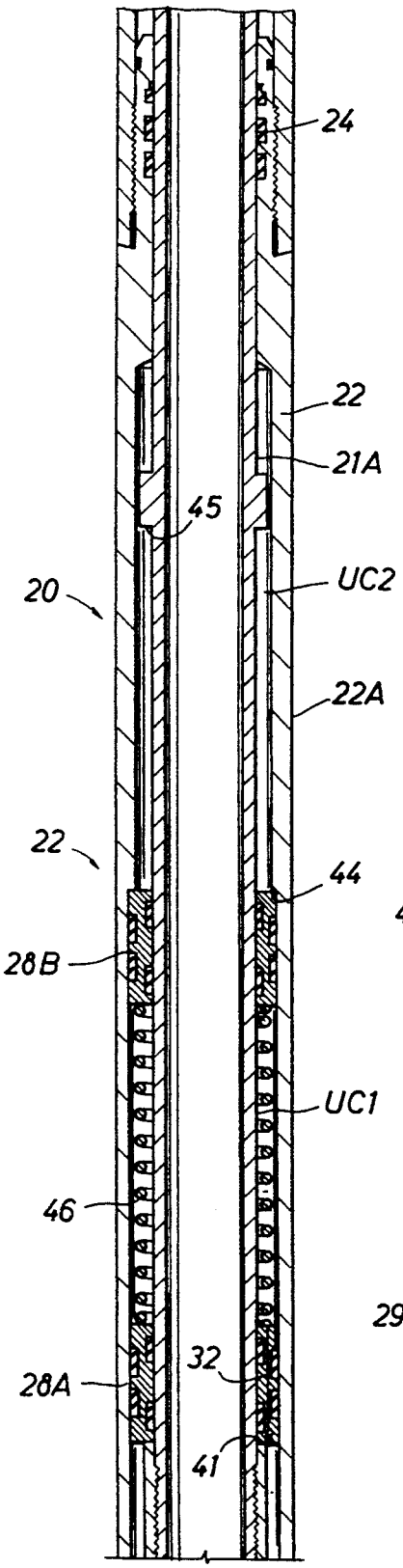
FIGS. 2A, 2B and 2C are similar views of the jar, but during raising of the inner tubular member or mandrel in order to impart an upward blow to an object stuck in the well bore beneath the jar connected below the jar enhancer.
Figure 2B:
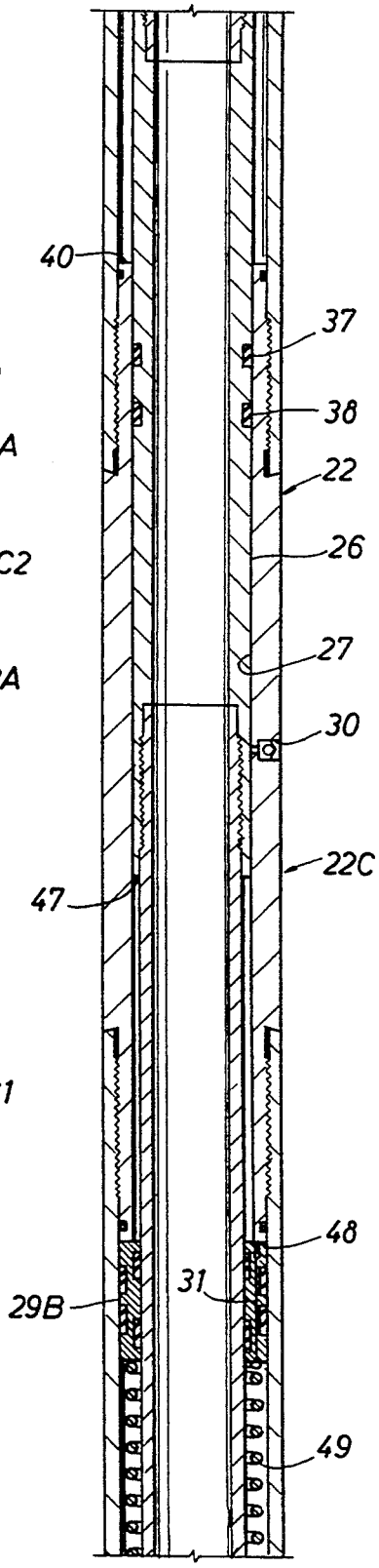
Figure 2C:
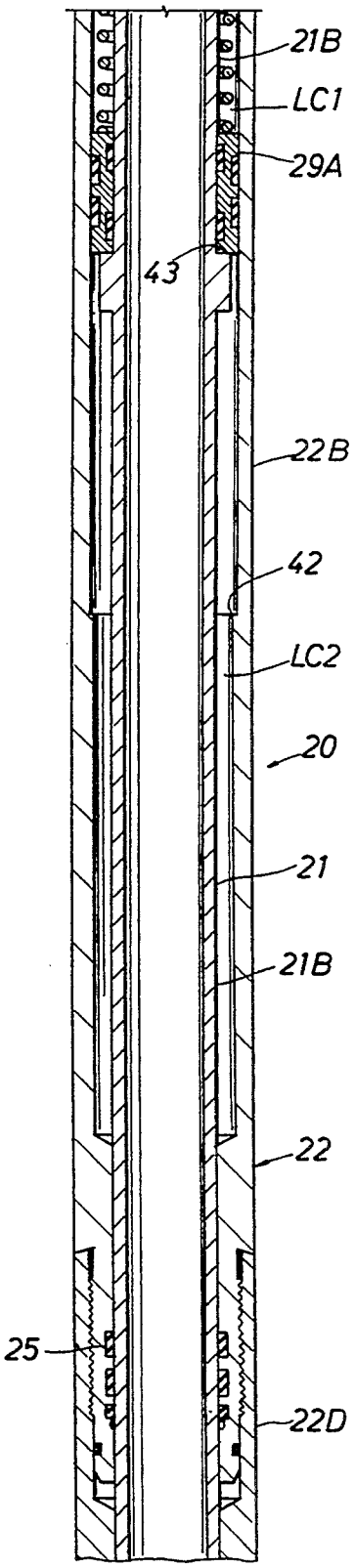
Figure 3A:
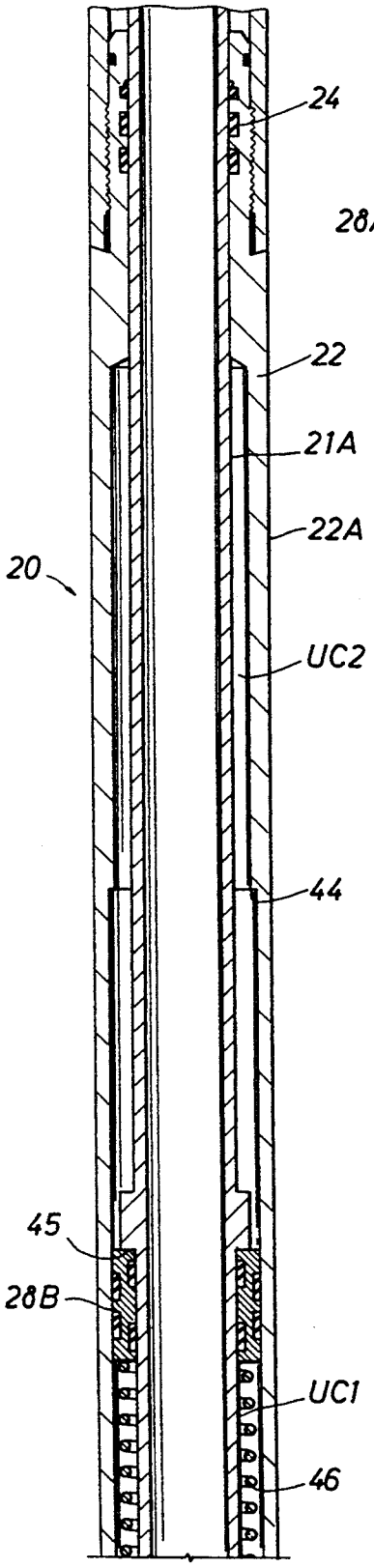
FIGS. 3A, 3B and 3C are further similar views of the jar enhancer, but during lowering of the inner tubular member or mandrel in order to impart a downward blow to the object stuck in the well bore.
Figure 3B:
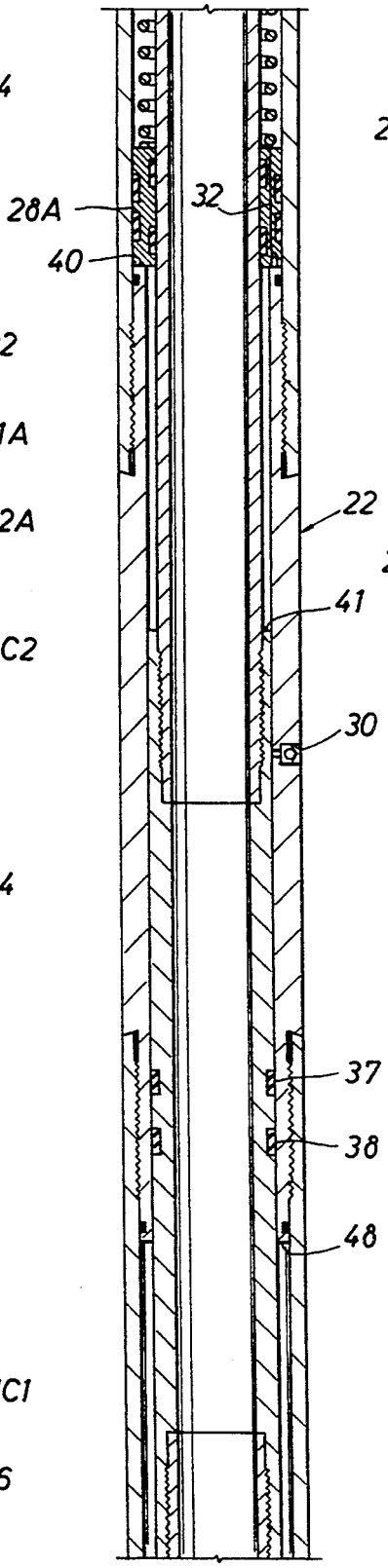
Figure 3C:
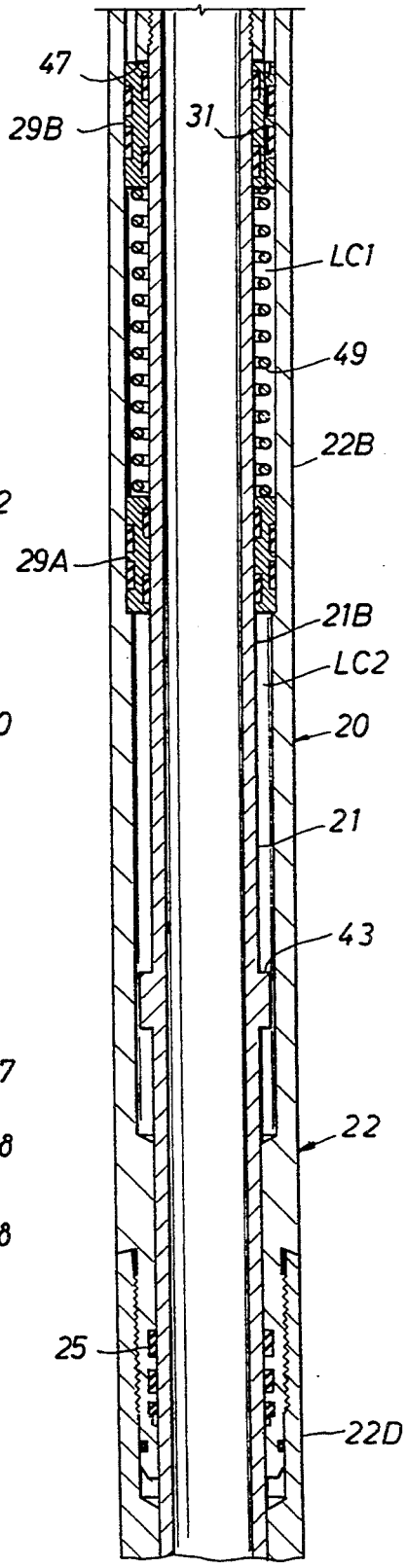

In the event an upward jar is to be applied to the stuck object, the upper end of the pipe string and, thus, the tubular member or mandrel 21 is raised to the position of FIGS. 2A, 2B, and 2C. As this occurs, the first set of upper and lower seal rings 28A and 29A are raised to a limited upper position, which may be determined by the stroke of the drive system above it, in order to further compress fluid in the upper chamber UC1 and lower chamber LC1 as well as the coil springs 46 and 49. At the same time, raising of the pistons 28A and 29A will create a vacuum in the fill chamber FC which vacuum actually adds to the accumulation of energy in the chambers UC1 and LC1. In any event, when the jar and its hammer are released for "free" travel into engagement with the anvil, the energy accumulated in the chambers UC1 and LC1 will enhance the impact of the jar by virtue of the force which the accumulated energy exerts upwardly on the tubular housing 22 connected to the portion of the jar in which the hammer is mounted.

Conversely, downward movement of the mandrel 21 with respect to the housing 22, in order to initiate the downward jar, will cause the seal rings 29B and 28B to move downwardly to further compress fluid in the chambers UC1 and LC1 as well as the springs 46 and 49.

The jar enhancer 20 is also of such construction as to enable the chambers UC1 and LC1 to be charged with a compressible fluid in the manner illustrated and described in the aforementioned copending application, Ser. No. 08/145,481. Thus, a pair of seal rings 37 and 38 are carried about the enlarged diameter portion 26 of the tubular section 21 of the inner tubular member for disposal within the fill chamber FC on opposite sides of the inner end of the port 30 when the inner and outer tubular members of the jar enhancer are in the neutral position shown in FIG. 1B. Assuming that, prior to use of the tool, neither of the chambers UC1 and LC1 has been fully charged, a bottle or container (not shown) of a compressible fluid is connected to the outer end of the port 30 with the valve on its outlet in position to be opened by the valve in the port 30. Thus, with the inner and outer tubular members in their neutral position, the compressed fluid will enter the small annular space between the seal rings 37 and 38.

As more fully described in the aforementioned application, in order to initially charge the lower chamber LC1, the inner tubular member is raised so as to move the lower seal ring 38 above the inner end of the port 30 so that the compressible fluid enters the fill chamber above the seal ring or piston 29B. As the inner tubular member continues to be raised, it continues to suck or withdraw compressed fluid from the container into the fill chamber above the seal ring 29B until it reaches its limited upper position, as determined, for example, by interengagable shoulders in the drive system above the jar enhancer.

As previously described, the seal ring 29B has one or more valve-controlled passageways or ports 31 formed therethrough which prevent flow upwardly therethrough, but permit flow downwardly therethrough. Thus, as the inner tubular member is raised, the valve in port 31 remains closed. On the other hand, when the tubular member is lowered from its raised position, the fluid drawn into the fill chamber is compressed so as to force the valve in port 31 open and thus initially charge the lower chamber LC1 with compressible fluid. It may be assumed, for purposes of this description, that the upper chamber UC1 has not been charged with a compressible fluid. If there is any compression of fluid in the fill chamber between the seal ring 28A and the seal ring 37, the compressed fluid is free to pass upwardly into the upper chamber. Since the chamber UC1 has not been charged, any compression of fluid above the seal ring 37 is negligible. Likewise, lowering of the inner tubular member from the raised position to the neutral position of FIG. 1B has only negligible effect insofar as the pressure of the fluid above the seal ring 37 is concerned.

In order to increase the pressure of the fluid in the lower chamber to the desired value, this raising and lowering of the inner tubular member may be repeated so as to cause successive charges of compressible fluid to be passed through the valve in port 31 into the lower chamber LC1. At this point and before lowering the inner tubular member, the valve at the outlet of the container is closed so that the compressed fluid in the charging chamber is directed through the valve in the seal ring 29B into the lower chamber. The effect, of course, is to multiply the pressure of the compressed gas received from the bottle. Then, of course, during each subsequent charging operation, the valve at the outlet of the bottle is opened to admit a further charge of compressed fluid to the charging chamber and then closed during lowering of the inner tubular member.

In order to then charge the upper chamber UC1, the foregoing procedure is reversed. That is, the inner tubular member is lowered from its neutral position in order to permit compressed fluid to flow into the charging chamber from the container, and then, upon closing of the outlet of the container, raised to force that fluid past the check valve in the upper seal ring 28A.

It is also contemplated that both the upper and lower chambers may be charged simultaneously. Thus, the inner tubular member may be alternately stroked to its limited upper and lower positions.

The primary purpose of the springs 46 and 49 is to resist movement of the pistons 28A or 29B during the charging procedure. However, it is anticipated that the valve-controlled passageways through the pistons and their frictional engagement with the tubular members may make them unnecessary.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A tool for enhancing the impact delivered to an object stuck in a well bore by means of a jar having a first tubular part connected to the object and a second tubular part having a hammer arranged to deliver a blow to an anvil on the first tubular part in response to vertical movement with respect to the first tubular part, said tool comprising;

a first tubular member having a lower end adapted to be connected to said second tubular part of the jar for raising and lowering therewith, a second tubular member vertically reciprocable and telescopically arranged with respect to the first tubular member to form an annular space between the first and second tubular members and having an upper end adapted to be connected to a well pipe string above it, upper means on the first tubular member sealably slidable with respect to the second tubular member and on the second tubular member sealably slidable with respect to the first tubular member to form an upper pressure chamber in the annular space between them, and lower means on the first tubular member sealably slidable with respect to the second tubular member and on the second tubular member sealably slidable with respect to the first tubular member to form a lower pressure chamber in the space between them, whereby, with the upper and lower chambers filled with a compressible fluid, movement of the second tubular member in one vertical direction with respect to the first tubular member will compress the fluid in the upper and lower pressure chambers to enhance the impact of a jar in the same vertical direction.

2. A tool as in claim 1, wherein the second member is reciprocable within the first member.

3. A Tool as in claim 1, wherein the upper and lower chambers are above the upper and lower means respectively, on the first tubular member so that raising of the second tubular member will enhance the impact of an upward jar.

4. A tool as in claim 1, wherein the upper and lower chambers are below the upper and lower means respectively on the first tubular member so that raising of the second tubular member will enhance the impact of a downward jar.

5. A tool for enhancing the impact delivered to an object stuck in a well bore by means of a jar having a first tubular part connected to the object and a second tubular part having a hammer arranged to deliver an upward blow to an anvil on the first tubular part in response to raising and a downward blow in response to lowering of the second tubular part with respect to the first tubular part, said tool comprising;

a first tubular member having a lower end adapted to be connected to said second tubular part of the jar for raising and lowering therewith, a second tubular member vertically reciprocable with respect to the first tubular member to form an annular space between them and having an upper end adapted to be connected to a well pipe string above it, a first set of upper and lower longitudinally spaced seal rings within the annular space and having equal diameter portions sealably slidable with respect to the tubular members, a second set of upper and lower longitudinally spaced seal rings within the annular space and having equal diameter portions sealably slidable with respect to the tubular members, said first tubular member having a first set of upper and lower longitudinally spaced shoulders engagable respectively with the upper and lower rings of the first set to limit their movement in a downward direction and a second set of upper and lower longitudinally spaced shoulders engagable respectively with the upper and lower rings of the second set to limit their movement in an upward direction, said second tubular member having a first set of upper and lower shoulders engagable with the upper and lower rings of the first set to raise the upper and lower rings of the first set with it, upon raising of the second tubular member, and a second set of upper and lower longitudinally spaced shoulders engagable with the upper and lower rings of the second set to lower the upper and lower rings of the second set with it, upon lowering of the second tubular member, the upper seal rings of the first and second sets forming an upper pressure chamber in the annular space between them, the lower seal rings of the first and second sets forming a lower pressure chamber in the annular space between them, whereby, with the chambers filled with a compressible fluid, raising of the second member will compress the fluid in the upper and lower chambers to enhance the impact of an upward jar and lowering of the second member will compress the fluid in the lower chamber to enhance the impact of a downward jar.

6. A tool as in claim 5, wherein the first set of upper and lower shoulders on the second tubular member are essentially vertically adjacent the upper and lower shoulders on the first tubular member, respectively, and the second set of upper and lower shoulders on the second set are essentially vertically adjacent the upper and lower shoulders on the second set, respectively, when said second tubular member is in a neutral position.

7. A tool as in claim 5, wherein means formed in the outer of the first and second tubular members through which fluid may be introduced into a charging chamber to receive the compressible fluid between the members intermediate the upper seal ring of the first set and lower seal ring of the second set, the upper seal ring of the first set of seal rings has valve means formed therein to permit flow from the charging chamber only into the upper chamber, and the lower seal ring of the second set of seal rings has valve means formed therein to permit flow from the charging chamber only into the lower pressure chamber.

8. A tool as in claim 5, wherein the second tubular member is reciprocable within the first tubular member.

* * * * *